US005857500A

United States Patent [19]

Payne et al.

[11] Patent Number: 5,857,500

[45] Date of Patent: Jan. 12, 1999

[54] SYSTEM AND METHOD FOR TESTING FOR ERROR CONDITIONS IN A FUEL VAPOR RECOVERY SYSTEM

[75] Inventors: Edward A. Payne, Greensboro; Hal C. Hartsell, Jr., Kernersville, both of N.C.

[73] Assignee: Gilbarco Inc., Greensboro, N.C.

[21] Appl. No.: 563,686

[22] Filed: Jun. 16, 1995

Related U.S. Application Data

[62] Division of Ser. No. 192,669, Feb. 7, 1994, Pat. No. 5,450, 883.

[51] Int. Cl.[6] ..... B67D 5/34

[52] U.S. Cl. ..... 141/59; 141/7; 141/8; 141/94; 73/168

[58] Field of Search ..... 141/7, 8, 44, 45, 141/59, 94, 290, 302; 73/40.5 R, 49.1, 168

[56] References Cited

U.S. PATENT DOCUMENTS

| | | | |
|---|---|---|---|
| 3,002,380 | 10/1961 | Grove | 73/168 |
| 3,054,288 | 9/1962 | Bowman et al. | 73/168 |
| 3,225,591 | 12/1965 | Orkney, Jr. et al. | 73/168 |
| 3,763,901 | 10/1973 | Viland | 141/8 |
| 3,926,230 | 12/1975 | Stary et al. | 141/45 |
| 3,940,020 | 2/1976 | McCrory et al. | 222/52 |
| 4,172,477 | 10/1979 | Reich | 141/8 |
| 4,608,857 | 9/1986 | Mertens et al. | 73/40.5 R |
| 4,705,459 | 11/1987 | Buisine et al. | 417/53 |
| 4,796,466 | 1/1989 | Farmer | 73/40.5 R |
| 4,905,511 | 3/1990 | Reinhold | 73/168 |
| 5,038,838 | 8/1991 | Bergamini et al. | 141/59 |
| 5,040,577 | 8/1991 | Pope | 141/59 |
| 5,050,092 | 9/1991 | Perry | 364/506 |
| 5,151,111 | 9/1992 | Tees et al. | 141/59 X |
| 5,195,564 | 3/1993 | Spalding | 141/1 |
| 5,199,471 | 4/1993 | Hartman | 141/5 |
| 5,213,142 | 5/1993 | Koch et al. | 141/59 |
| 5,269,353 | 12/1993 | Nanaji et al. | 141/59 |
| 5,317,899 | 6/1994 | Hutchinson et al. | 73/40.5 R |
| 5,323,817 | 6/1994 | Spalding | 141/1 |
| 5,325,896 | 7/1994 | Koch et al. | 141/59 |
| 5,332,008 | 7/1994 | Todd et al. | 141/5 |
| 5,332,011 | 7/1994 | Spalding | 141/59 |
| 5,365,459 | 11/1994 | Perry | 73/168 |
| 5,450,883 | 9/1995 | Payne et al. | 141/59 |

*Primary Examiner*—J. Casimer Jacyna
*Attorney, Agent, or Firm*—Rhodes Coats & Bennett, L.L.P.

[57] ABSTRACT

A vapor recovery system used with fuel dispensers and having error detection capabilities incorporated therein for detecting vapor leaks and performance deficiencies in the vapor recovery system. The vapor recovery system includes a fuel nozzle connected to a fuel source for pumping fuel into a vehicle. A vapor transfer line is connected to the nozzle and has a connected pump which pumps fuel vapor from the nozzle through the vapor transfer line and into a vapor holding tank. A pair of test valves are connected in the vapor transfer line on opposite sides of the pump and are used to isolate selected sections of the vapor recovery system for test purposes. Connected between each test valve and pump is a pressure sensor for measuring pressure in the vapor transfer line. A digital processor is connected to the vapor recovery system to control the vapor recovery system and to place the vapor recovery system in various test modes. During the test modes, the digital processor receives pressure signals from the pressure sensors and compares these pressure signals to references to determine if a fault condition exists.

9 Claims, 1 Drawing Sheet

SYSTEM AND METHOD FOR TESTING FOR ERROR CONDITIONS IN A FUEL VAPOR RECOVERY SYSTEM

This application is a division of application Ser. No. 08/192,669, filed Feb. 7, 1994 now U.S. Pat. No. 5,450,883.

FIELD OF THE INVENTION

This invention relates generally to fuel vapor recovery systems used with fuel dispensers, and more particularly to fuel vapor recovery systems having error condition detection capabilities incorporated therein for detecting vapor leaks and performance deficiencies.

BACKGROUND OF THE INVENTION

As gasoline or other fuel is pumped into an automobile or other motor vehicle, fuel vapor is released. These vapors must be collected to prevent their escape and pollution of the surrounding environment. Fuel dispensing systems of the prior art often include vapor recovery systems for collecting the vapor released as fuel is dispensed into an automobile through a hand-held nozzle. Typically, fuel vapor recovery systems of the prior art include a vapor transfer line extending from the nozzle to a vapor holding tank. A pump is connected in the vapor transfer line and is operable to pump the vapor from the nozzle, through the vapor transfer line, and into the ullage of the liquid fuel tank. Vapors pumped into the tank can condense for use as liquid fuel or be stored for subsequent disposal.

To assure maximum performance of fuel vapor recovery systems, and to verify compliance with local, state and federal laws pertaining to vapor recovery systems, the integrity of vapor recovery systems must be periodically verified by testing. Testing should be performed to assure that there are no vapor leaks or blockages in the vapor transfer line, or pump deficiencies.

In the prior art, manual methods are typically used to check for leaks and deficiencies in the vapor recovery system. In order to manually test the various components of a vapor recovery system, trained personnel must gain physical access to the various components of the vapor recovery system. Gaining physical access to system components for testing purposes is difficult because many of the vapor recovery system components are either located underground or housed within the fuel dispenser housing. Furthermore, calibrated test instrumentation and appropriately trained personnel must be available to manually test the vapor recovery system for leaks, blockages, and deficiencies. The invasive nature of manual testing also gives rise to the potential for damaging the vapor recovery system during the testing process. Due to the difficulty in accessing the vapor recovery system, need for trained personnel, and the potential for damaging the vapor recovery system during testing, these prior art methods of testing fuel vapor recovery systems are inadequate.

SUMMARY OF THE INVENTION

The present invention provides an improved system and method for testing for error conditions in a fuel vapor recovery system that forms a part of a fuel delivery system. In particular, the present invention has the capability to test for leaks and blockages throughout the vapor recovery system. In addition, the system will detect pump operating deficiencies in a vapor pump that forms a part of the vapor recovery system.

In one embodiment of the present invention, the vapor recovery system includes a vapor transfer line that extends from a nozzle, through a vapor pump, and to a tank. A pair of test valves are connected in the vapor transfer line on opposite sides of the vapor pump. Between each test valve and the vapor pump there is connected a pressure sensor. A processor is connected to the vapor recovery system for controlling the actuation of the test valves and for receiving pressure signals from the pressure sensors such that the vapor recovery system can be remotely tested for fault conditions.

The vapor recovery system is tested for leaks in the vapor transfer line or for a pump deficiency by closing either one of the test valves while the other test valve is open. This isolates a section of the vapor transfer line located between the closed test valve and the pump. The pump is then operated at a selected speed to generate pressure in the isolated section of the vapor transfer line. The pressure generated in the isolated section is measured by the pressure sensor located in the isolated section and a corresponding test pressure signal is directed to the processor. The processor compares the test pressure signal with a reference pressure to determine if a leak exists in the vapor transfer line between the closed test valve and the pump or if there is a pump deficiency.

The vapor recovery system can also be tested for a blockage by opening both test valves and operating the pump at a selected speed so as to draw vapor from the nozzle to the tank. The pressure sensors measure pressure on both sides of the pump and direct corresponding pressure signals to the processor. The processor processes the pressure signals to derive the restriction in the vapor transfer line and compares the derived restriction with a standard reference to determine if a blockage exists in the vapor transfer line.

The invention also permits testing of the efficiency of the vapor pump and adjustments to compensate for wear-induced changes to its flow characteristics.

The present invention further allows for effective automatic testing of the fuel vapor recovery system. Because testing is completely controlled through the operation of a digital processor, the need to gain physical access to components within the vapor recovery line to determine the integrity of the vapor recovery system is eliminated.

BRIEF DESCRIPTION OF THE DRAWINGS

The single FIGURE is a schematic illustration of the preferred embodiment of the vapor recovery system of the present invention.

DETAILED DESCRIPTION OF THE PREFERRED EMBODIMENT

Figure 1:
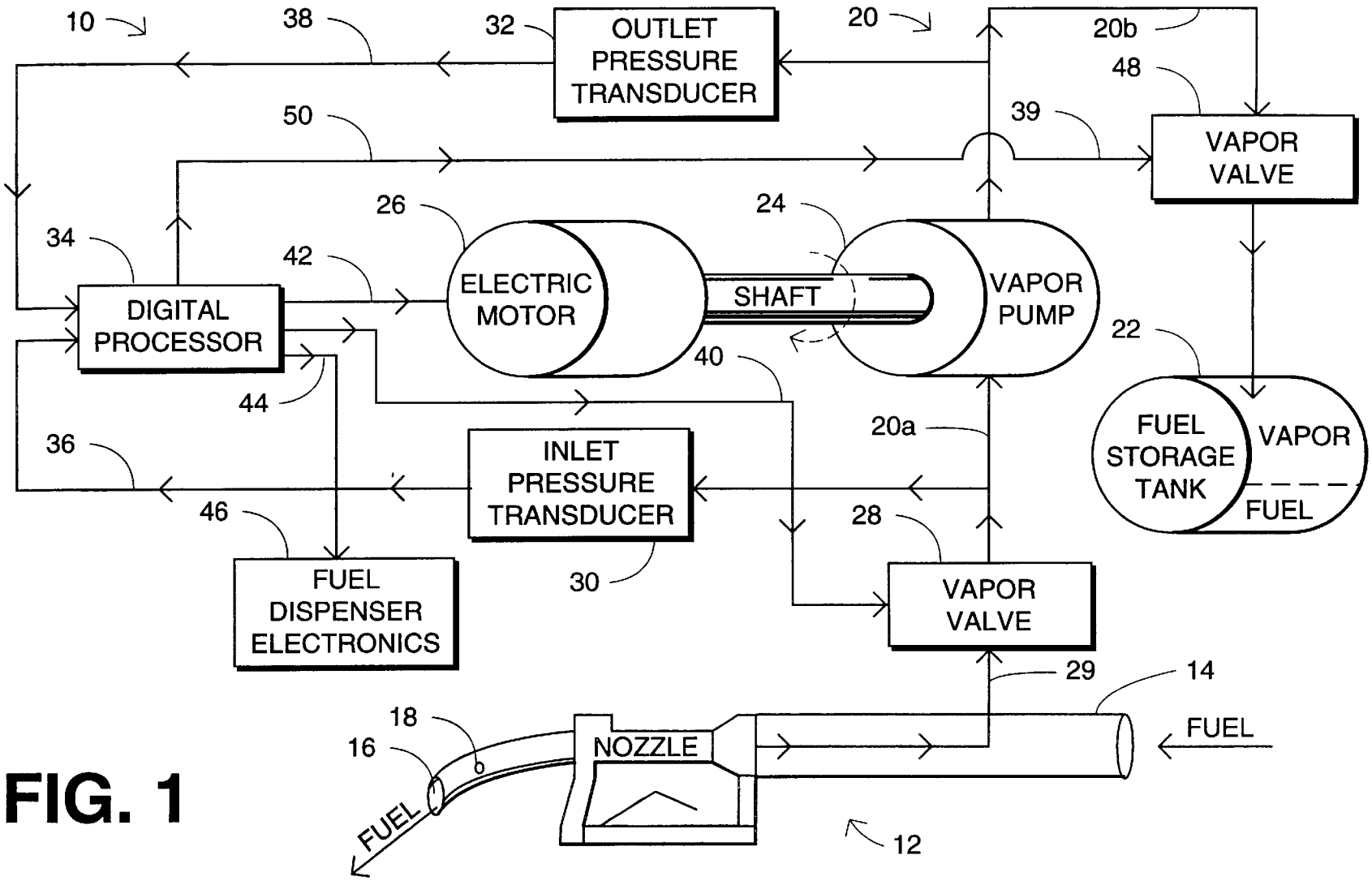

The present invention relates to an improved system and method for testing for fault conditions in a fuel vapor recovery system that forms a part of a fuel delivery system. Vapor recovery systems used to recover fuel vapors that are released as fuel is pumped from a fuel nozzle are known in the prior art. For an example of a fuel vapor recovery system, one is referred to the disclosure found in U.S. Pat. No. 5,040,577 to Pope, which is expressly incorporated herein by reference. Improvements on the Pope apparatus are shown in copending U.S. patent application Ser. No. 07/946,741 filed Sep. 16, 1992 and Ser. No. 07/968,390 filed Oct. 29, 1992. The present invention is desirably used in conjunction with those improvements, so the disclosures of those two pending applications are incorporated herein by reference. Other patents showing assist-type vapor recovery systems in which the invention may be used are U.S. Pat. No. 5,038,838 to Bergamini et al. and U.S. Pat. No. 5,195,564 to Spalding.

The present invention is directed to an improved vapor recovery system that has the capability to test for leaks, blockages, and deficiencies throughout the vapor recovery system. In describing the system of the present invention it should be appreciated that the general structure of fuel vapor recovery systems are well known in the prior art, and therefore a detailed description of such is not needed.

With further reference to the drawing, the vapor recovery system of the present invention is shown therein and indicated generally by the numeral 10. Vapor recovery system 10 includes a conventional vapor recovery nozzle 12 for directing fuel from a fuel inlet 14 to a spout 16. Nozzle 12 includes a vapor inlet 18. Vapor inlet 18 is communicatively connected to a vapor transfer line 20 that extends from nozzle 12 to a reservoir or tank 22, typically, but not necessarily, the ullage of the liquid fuel tank.

Vapor transfer line 20 includes an inlet line 20*a* extending from nozzle 12 to a vapor pump 24 and an outlet line 20*b* extending from vapor pump 24 to tank 22. Typically, a portion of the inlet line 20*a* is a hose 29 outside the fuel dispenser. Integral with pump 24 is an electric motor 26 that drives pump 24 at selected speeds to induce fuel vapor into vapor inlet 18, through vapor transfer line 20, and into tank 22. A pair of test valves 28,48 are connected in the vapor transfer line 20 on opposite sides of pump 24 and are used to isolate selected sections of the vapor transfer line 20 for test purposes. In particular, test valve 28 is connected in inlet line 20*a* and is used to isolate the section of the inlet line 20*a* from test valve 28 to pump 24. Test valve 48 is connected in outlet line 20*b* and is used to isolate the section of the outlet line 20*b* from test valve 48 to pump 24. Preferably, valve 28 is located in the dispenser housing near the fitting to hose 29, and the valve 48 is located near tank 22. However, the valve 28 may be located in the nozzle 12 to good advantage. This permits checking conditions of the hose between the dispenser housing and the nozzle.

If the valve is not in the nozzle, the nozzle and hose can still be checked for leaks. The vapor inlet of the nozzle may be blocked, such as by the hand of an operator, and the vapor pump operated. The resultant vacuum drawn upstream of the pump can be measured to ascertain the efficacy of the pump and to check for leaks in the hose and nozzle.

Connected between test valves 28 and 48 and pump 24 are pressure sensors 30 and 32, Pressure sensor 30 measures the pressure in the inlet line 20*a* between test valve 28 and pump 24, and pressure sensor 32 measures the pressure in the outlet line 20*b* between test valve 48 and pump 24.

A digital processor 34 is included in the vapor recovery system 10 for controlling the same. Processor 34 is connected to pressure sensors 30 and 32 through pressure signal input lines 36 and 38, respectively. The pressure signal input lines 36 and 38 allow pressure signals produced by pressure sensors 30 and 32 to be transmitted and input to processor 34. The pressure signals received by processor 34, as discussed in more detail below, are processed and compared to stored reference pressure values to determine if an error condition exists in vapor recovery system 10, according to a routine controlled by the processor 34. Instructions for the routine and data used in the routine may be stored in a conventional memory unit such as a ROM, PROM or flash memory accessible by the processor 34 in conventional fashion.

Processor 34 is also connected to test valves 48 and 28 through test valve control lines 39 and 40 respectively and to the electric motor 26 through control line 42. Processor 34 actuates test valves 28 and 48 and controls electric motor 26 to permit automatic testing of the vapor recovery system 10. Processor 34 is also connected to and actuates conventional fuel dispenser control electronics 46 through control line 44. Fuel dispenser control electronics 46 prevents the flow of fuel through nozzle 12 during vapor line testing. The fuel dispenser control electronics may be as described in Gilbarco's pending application Ser. No. 946,741 filed on Sep. 16, 1992.

In operation, vapor recovery system 10 has an operational mode where vapor is pumped from nozzle 12, through vapor transfer line 20, to tank 22 as fuel is being pumped from nozzle 12. In the operational mode, test valves 28 and 48 are open to allow vapor to pass through vapor transfer line 20. When not in this operational mode, the vapor recovery system 10 can be placed in various test modes to test for vapor leaks, blockages, and pump deficiencies.

To test for a vapor leak in vapor inlet line 20*a* or a malfunctioning pump 24, the processor 34 actuates a command to run the vapor recovery system through a first test mode. This command may be triggered by an operator, a time clock or a remote computer or controller, as desired. In the first test mode, processor 34 sends a control signal over test valve control line 40 to close test valve 28 located in inlet line 20*a*. Closing test valve 28 isolates the portion of the inlet line 20*a* between test valve 28 and pump 24. Test valve 48 located in outlet line 20*b* remains in an open position.

Digital processor 34 also signals electric motor 26 to drive pump 24 at a selected speed to cause a vacuum to be produced in the isolated portion, inlet line 20*a*. Inlet pressure sensor 30 detects the pressure generated in inlet line 20*a* and produces a corresponding test pressure signal. The test pressure signal from pressure sensor 30 is directed over pressure signal input line 36 and is input into processor 34.

Processor 34 is programmed to process the test pressure signal to determine if a leak in the isolated section of inlet line 20*a* exists or if a pump deficiency exists. To determine if an error condition exists, the processor compares the test pressure signal with a reference pressure value stored in the processor. The reference pressure value corresponds to the pressure that should exist in the isolated section of the inlet line 20*a* at the selected pump speed in the absence of either a leak in the isolated section of inlet line 20*a* or pump deficiency. The reference pressure value can be determined through empirical testing. A table of reference pressure values corresponding to various pump speeds is stored in processor 34 or memory available to it, so that vapor recovery system 10 can be tested at various pump speeds. Processor 34 detects a leak in the isolated section of inlet line 20*a* or a pump deficiency when there is a sufficiently large discrepancy between the input test pressure signal and the stored reference pressure valve.

If a vapor leak is detected in inlet line 20*a*, digital processor 34 directs a signal over control line 44 to disable the fuel dispenser to prevent fuel from being pumped through nozzle 12 while an error condition exists.

Vapor inlet line 20*a* can also be tested for a vapor leak by running the system through a second test mode. In the second test mode, valve 28 is opened and vapor inlet 18 is blocked by an operator to isolate vapor inlet line 20*a* all the way from vapor inlet 18 to pump 24. Processor 34 then signals electric motor 26 to drive pump 24 at a selected speed. The operation of pump 24 at the selected speed causes a pressure to be generated in the isolated section of the vapor inlet line 20*a* which extends from vapor inlet 18 to the pump 24. Pressure sensor 30 measures the pressure in inlet line 20*a* and directs a corresponding test pressure signal to processor 34. As in the first test mode, processor 34 compares the input test pressure signal to a reference pressure to determine whether a leak exists in the isolated section of inlet line 20*a* or whether there is a pump deficiency. If the valve 28 is located in the nozzle 12, as discussed above, this test can test for leaks in the hose portion of the vapor return line by the closing of that valve.

The results of the first and second test modes can also be compared with one another to determine whether a vapor leak detected in the first or second test modes exists in the section of the inlet line 20*a* between test valve 28 and pump 24 or in hose 29 or in nozzle 12. In particular, the failure to detect a vapor leak during the first test mode would indicate that the section of the vapor inlet line 20*a* between test valve 28 and pump 24 was not leaking and that pump 24 was operating properly. Accordingly, an error condition detected only in the second test mode, and not in the first test mode, would indicate that the vapor leak existed in the hose 29 from the dispenser or the nozzle 12. Thus, by isolating and testing various sections of the inlet line 20*a*, one can more precisely identify the location of a leak condition in the inlet line 20*a* and determine what repair is needed.

An operator can check for vapor leaks in vapor outlet line 20*b* in a manner similar to checking for vapor leaks in vapor inlet line 20*a* by placing vapor recovery system 10 in a third test mode. The third test mode entails a two-stage test. First, the processor 34 closes valve 28, opens valve 48 and operates the motor 26 at a selected speed. The resulting vacuum measured by sensor 30 is noted. Then, the processor 34 opens valve 28, closes valve 48 and operates the motor 26 at the selected speed. The pressure measured at sensor 32 is compared with the noted vacuum. If these are not approximately equally separated from atmospheric pressure, it can be determined that a leak exists in outlet line 20*b*, and an appropriate shut-down signal communicated along line 44 to the dispenser control electronics 46.

A fourth test mode can also be undertaken to detect blockages in the vapor recovery system 10. The fourth test mode detects such fault conditions during normal operation with test valves 28 and 48 being open and vapor being pumped from nozzle 12, through vapor transfer line 20, to holding tank 16. As vapor is being pumped through the vapor transfer line 20, pressure sensors 30 and 32 measure the pressure in inlet and outlet lines 20*a* and 20*b* and produce corresponding pressure signals. The corresponding pressure signals are sent to processor 34. Processor 34 processes the pressure signals to derive a flow restriction value for vapor transfer line 20. The derived restriction for vapor transfer line 20 is compared to a standard reference to determine whether a blockage exists in the vapor transfer line 20. If a blockage is detected, the processor 34 signals fuel dispenser control electronics 46 to prevent the flow of fuel to nozzle 12.

In a fifth test mode, changes in the flow characteristics of the pump 24 induced by wear can be determined. Typically, pump 24 is a positive displacement pump or other pump, the flow rate of which is directly proportional to its rotational speed. That proportion can change over time as the vanes or other moving parts of the pump are subject to wear. Thus, the precise vapor volume pumping rate control thought to be achieved by precisely controlling the rotation speed of the motor 26 driving the pump 24 can deteriorate with wear. The present invention, however, provides a way to measure and compensate for such deterioration.

First, a value is stored in processor 34 or a memory available to it of the vacuum obtainable in line 20*a* with valve 28 closed and valve 48 open, at a given rotational speed. Preferably, values for multiple speeds can be stored to obtain a range of data points to increase the reliability of the test. Then, after a period of use of the system, say, six months or a year, the test can be re-run. Changes in the vacuum attained at the various speeds can be attributed to wear, and the calibration of the speed controls to motor 26 from processor 34 can be altered to restore the desired vapor volume flow rate. The new values can be stored as reference data for the next test. The tests can be performed automatically at timed intervals or upon any desired cue.

Vapor recovery system 10 of the present invention, as discussed above, provides an effective system and method for testing for leaks, blockages, and pump deficiencies. No manual access to components in the vapor recovery system 10 is required for testing. The location of an error in the vapor recovery system 10 can also be more specifically identified with the fault detection capabilities of the present invention. In addition, when vapor recovery system 10 has a plurality of vapor transfer lines, (i.e. multiple hoses and nozzles for a dispenser and multiple vapor return lines to underground tanks) the particular hose or tank line which is malfunctioning can be identified. Once identified, the faulty vapor transfer line and associated fuel dispenser hose can be rendered inoperable and the other hoses can safely remain in operation.

The present invention may, of course, be carried out in other specific ways than those herein set forth without departing from the spirit and essential characteristics of the invention. For example, a vapor recovery system could be designed that did not provide for each different test mode described herein. Also, while the processor has been described as being a digital electronic processor, similar control could be achieved with analog circuits or mechanical devices. The present embodiments are, therefore, to be considered in all respects as illustrative and not restrictive and all changes coming within the meaning and equivalency range of the appended claims are intended to be embraced therein.

What is claimed is:

1. A method of detecting vapor leaks and pump performance deficiencies in a fuel delivery and vapor recovery system that dispenses fuel through a nozzle and includes a vapor transfer line connected to a pump for pumping vapor from the nozzle to a vapor outlet, comprising the steps of:

(a) connecting a first test valve in the vapor transfer line upstream of the pump;

(b) connecting a first pressure sensor in the vapor transfer line between the first test valve and the pump;

(c) closing the first test valve so as to isolate a first section of the vapor transfer line between the first test valve and the vapor recovery pump;

(d) operating the pump at a selected speed so as to create a vacuum in the first isolated section of the vapor transfer line;

(e) measuring the vacuum in the first isolated section of the vapor transfer line with the first pressure sensor and producing a test pressure signal representing the measured vacuum;

(f) inputting the test pressure signal from the first pressure sensor into a processor; and (g) comparing the test pressure signal and a first reference pressure to determine if an error condition exists between the first test valve and the pump.

2. The method of claim 1 further including the steps of:

(a) connecting a second test valve in the vapor transfer line on a side of the pump opposite the first test valve;

(b) connecting a second pressure sensor in the vapor transfer line between the second test valve and the pump;

(c) closing the second test valve so as to isolate a second portion of the vapor transfer line located between the second test valve and the pump;

(d) operating the vapor recovery pump at a selected speed with the first test valve open so as to change the pressure between the second test valve and the pump;

(e) sensing the pressure in the vapor transfer line between the second test valve and the pump with the second pressure sensor and producing a corresponding test pressure signal pressure;

(f) inputting the test pressure signal from the second pressure sensor into a processor; and (g) comparing the test pressure signal from the second reference pressure sensor with a second reference pressure to determine if a fault condition exists in the vapor transfer line between the second test valve and the pump.

3. The method of claim 1 further including the steps of:

(a) connecting a second pressure sensor in the vapor transfer line on a side of the pump opposite the first pressure sensor;

(b) opening the first test valve;

(c) operating the pump at a selected speed;

(d) sensing the pressure on both inlet and outlet sides of the pump with the first and second pressure sensors as vapor is pumped through the vapor transfer line and generating corresponding operational pressure signals; and (e) processing the operational pressure signals to derive the restriction in the vapor transfer line and comparing the derived restriction with a standard reference to determine if a blockage exists in the vapor transfer line.

4. The method of claim 1 wherein the first test valve is connected between the nozzle and the pump and wherein the method further includes:

(a) opening the first test valve;

(b) blocking a vapor inlet associated with the nozzle so as to isolate the vapor transfer line from the vapor inlet to the pump;

(c) operating the pump at a selected pump speed so as to generate a pressure in the vapor transfer line between the vapor inlet and the pump;

(d) measuring the pressure in the vapor transfer line between the vapor inlet and the pump and generating a corresponding test pressure signal; and (e) comparing a second reference pressure with the test pressure signal corresponding to the pressure generated between the vapor inlet and the pump to determine if a fault condition exists between the nozzle and the pump.

5. The method of claim 1 further comprising the step of stopping the flow of fuel to the nozzle in response to the sensing of a fault condition.

6. The method of claim 1 further comprising the step of remotely controlling the actuation of the first test valve.

7. The method of claim 6 including the step of directing a control signal from a processor to the first test valve for opening or closing the first test valve.

8. A method of detecting vapor leaks and pump performance deficiencies in a fuel delivery and vapor recovery system that dispenses fuel through a nozzle and includes a vapor transfer line connected to a pump for pumping vapor from a vapor inlet in the nozzle to a vapor outlet, comprising the steps of:

(a) connecting a pressure sensor in the vapor transfer line between the nozzle and the pump;

(b) blocking the vapor transfer line in the nozzle so as to isolate a section of the vapor transfer line between the vapor inlet and the vapor recovery pump;

(c) operating the pump at a selected speed so as to generate a pressure in the isolated section of the vapor transfer line;

(d) measuring the pressure in the isolated section of the vapor transfer line with the pressure sensor and producing a test pressure signal representing the measured pressure;

(e) inputting the test pressure signal from the pressure sensor into a processor; and (f) comparing the test pressure signal with a reference pressure to determine if a fault condition exists between the vapor inlet in the nozzle and the pump.

9. A method of testing a vapor recovery fuel dispenser that has a liquid dispensing nozzle and a liquid conveying line to the nozzle, a vapor return port in the nozzle connected through a vapor return line to a vapor reservoir, a valve in the vapor return line between the nozzle and the reservoir, and a pump in the vapor return line between the nozzle and the valve driven by a motor for pumping vapor through the vapor return line at a volumetric rate determined by the pump motor speed, comprising closing the valve, driving the pump with the motor at a given speed, measuring the pressure in the vapor return line while the valve is closed and the motor is driving the pump at a predetermined speed and storing the measurement, opening the valve and using the pump and motor to pump vapor during fueling operations, and subsequently, closing the valve, operating the motor at the predetermined speed, measuring the pressure in the vapor return line and comparing the measurement with the stored value to determine any needed re-computation of the relationship of the motor speed to the volumetric flow through said pump to assure control of the volumetric flow.

* * * * *